US011154732B2

(12) United States Patent
Chen

(10) Patent No.: US 11,154,732 B2
(45) Date of Patent: Oct. 26, 2021

(54) SPEED-CONTROLLABLE LIFTER

(71) Applicant: Hongfa Chen, Quzhou (CN)

(72) Inventor: Hongfa Chen, Quzhou (CN)

( * ) Notice: Subject to any disclaimer, the term of this patent is extended or adjusted under 35 U.S.C. 154(b) by 342 days.

(21) Appl. No.: 16/441,023

(22) Filed: Jun. 14, 2019

(65) Prior Publication Data

US 2020/0391056 A1 Dec. 17, 2020

(51) Int. Cl.
*A62B 1/10* (2006.01)

(52) U.S. Cl.
CPC ..... *A62B 1/10* (2013.01)

(58) Field of Classification Search
CPC ..... A62B 1/10
See application file for complete search history.

(56) References Cited

U.S. PATENT DOCUMENTS 3,188,052 A * 6/1965 Longworth ..... A62B 1/10 182/234
2004/0094331 A1* 5/2004 Mese ..... C10M 171/001 175/65
2005/0126857 A1* 6/2005 Hamada ..... A62B 1/14 182/231
2011/0174914 A1* 7/2011 Yang ..... A62B 1/10 242/395.1

FOREIGN PATENT DOCUMENTS

EP 2609963 A1 * 7/2013 ..... A62B 1/08
WO WO-2014090322 A1 * 6/2014 ..... A62B 1/10

* cited by examiner

*Primary Examiner* — Alvin C Chin-Shue

(57) ABSTRACT

A speed-controllable lifter includes a movable plate, a fixed plate which connected with a hanging ring via a sliding rope. The movable plate is hanged on the sliding rope. A speed control device is provided in the fixed plate, having a stop hub, two stop pads, two arc-shaped stop pad supports and an adjustment means which includes an upper camshaft, a lower camshaft and an adjustment shaft arranged on the upper camshaft for adjusting an opening degree between movable ends of the two stop pad supports. A brake device is provided in the movable plate, having a brake drum, two brake pads, two arc-shaped brake pad supports and a brake means which includes a driving shaft, a driven shaft and a control bar arranged on the driving shaft for controlling a degree of the tightness of movable ends of the two brake pad supports.

5 Claims, 6 Drawing Sheets

SPEED-CONTROLLABLE LIFTER

TECHNICAL FIELD

The present invention relates to a speed-controllable lifter.

BACKGROUND

With the increasing number of high-rise buildings, how to escape safely in an emergency situation draws attention of people. Before the present disclosure was made, although there were various high-rise escape devices, but none of them has been put into commercial production and used in public due to their complicated structure and inconvenient operation, especially due to poor reliability of the brakes. Therefore, people generally use ladders or air cushions placed on the ground to escape from high-rise buildings in emergency cases. A known high-rise escape device typically includes a fixed plate, a movable plate and a hanging ring, the fixed plate and the movable plate are respectively provided with a central shaft. In use, the fixed plate and the hanging ring are connected with a rope and are fixed at a high place, the movable plate was hanged on the rope. An evacuee can be rescued by being connected to the movable plate via a buckle, and sliding to the ground with the movable plate.

SUMMARY

In order to solve the above technical problems, the objective of the present disclosure is to provide a speed-controllable lifter having a novel structure, the escape device not only has the advantages of simple structure and convenient operation, especially the brake part has particularly good reliability performance, thereby ensuring that the evacuee can slide onto the ground safely and reliably and achieve the purpose of escape.

The technical solution to achieve the above objectives is as follows, such speed-controllable lifter comprises a fixed plate, a movable plate and a hanging ring, the fixed plate and the hanging ring being connected together with a sliding rope, the movable plate being hanged on the sliding rope, the sliding rope being wound around a winding wheel arranged in the fixed plate with ends being fixed. A speed control device is provided in the fixed plate, the speed control device comprises a stop hub, two stop pads, two arc-shaped stop pad supports and an adjustment means; the adjustment means comprises an upper camshaft, a lower camshaft and an adjustment shaft arranged on the upper camshaft, an opening degree between movable ends of the two stop pad supports is adjustable by the adjustment shaft; the winding wheel is arranged on an outer periphery of the stop hub; a brake device is provided in the movable plate, the brake device comprises a brake drum, two brake pads, two arc-shaped brake pad supports and a brake means; the brake means comprises a driving shaft, a driven shaft and a control bar arranged on the driving shaft, a degree of tightness of movable ends of the two brake pads is controllable by the control bar.

In some embodiments, the upper camshaft and the lower camshaft are oppositely arranged, each on one side of a respective one of the two arc-shaped stop pad supports, and are hinged together by a connecting lever, the adjustment shaft is fixedly arranged on the upper camshaft, the adjustment shaft is provided with a limit step, and an arc-shaped rack is provided on the fixed plate to engage with the limit step.

In some embodiments, the driving shaft and the driven shaft are oppositely arranged, each on one side of a respective on of the two arc-shaped brake pad supports, and are hinged together by a connecting lever, the control bar is fixedly arranged on the driving shaft, a pressure spring is provided between movable ends of the two brake pad supports, the control bar and the pressure spring cooperate to control a tightness of the movable ends of the two brake pad supports. In some embodiments, a pressure spring guide sleeve is arranged around a periphery of the pressure spring, a length of the pressure spring guide sleeve is shorter than a length of the pressure spring in its nature state.

In some embodiments, a limiting buckle is provided on the movable plate, and the limiting buckle is engaged with the control bar, limiting a movement of the control bar.

The speed-controllable lifter of the present disclosure has the advantages as follows: compared with the prior art, the speed-controllable lifter provided by this invention mainly improves the braking components, not only provides simpler structure, more convenient operation, but also greatly improves the reliability of escape. First, with such speed control device installed in the fixed plate, on the one hand, one can adjust the sliding speed of the movable plate within a certain range to meet different needs of different evacuees to escape safely. On the other hand, the purpose of escape can be achieved regardless of whether the evacuee is able to control the speed of the movable plate. When the evacuees are completely unable to escape by themselves, or even lose sense or movement, by using the fixed plate adjustment shaft a person at the high place can help the evacuee slide onto the ground safely (In that case, the movable plate functions as a pulley). Second, with such speed control device installed in the fixed plate, the speed of the movable plate can be controlled within a certain range by operating the fixed plate, it is easier and more convenient to control the speed of the movable plate, preventing the evacuee from sliding downwards at a speed that is too high by accident, for example, due to improper operation or other reasons. Finally, since the brake structures of the fixed plate and the stop structures of the movable plate are the same, which are obtained by modifying the brake device of mature technology, they would have the advantages of good reliability, simple manufacture, dual insurance of sliding speed control, and therefore the product may be easily accepted by public.

Figure 1:
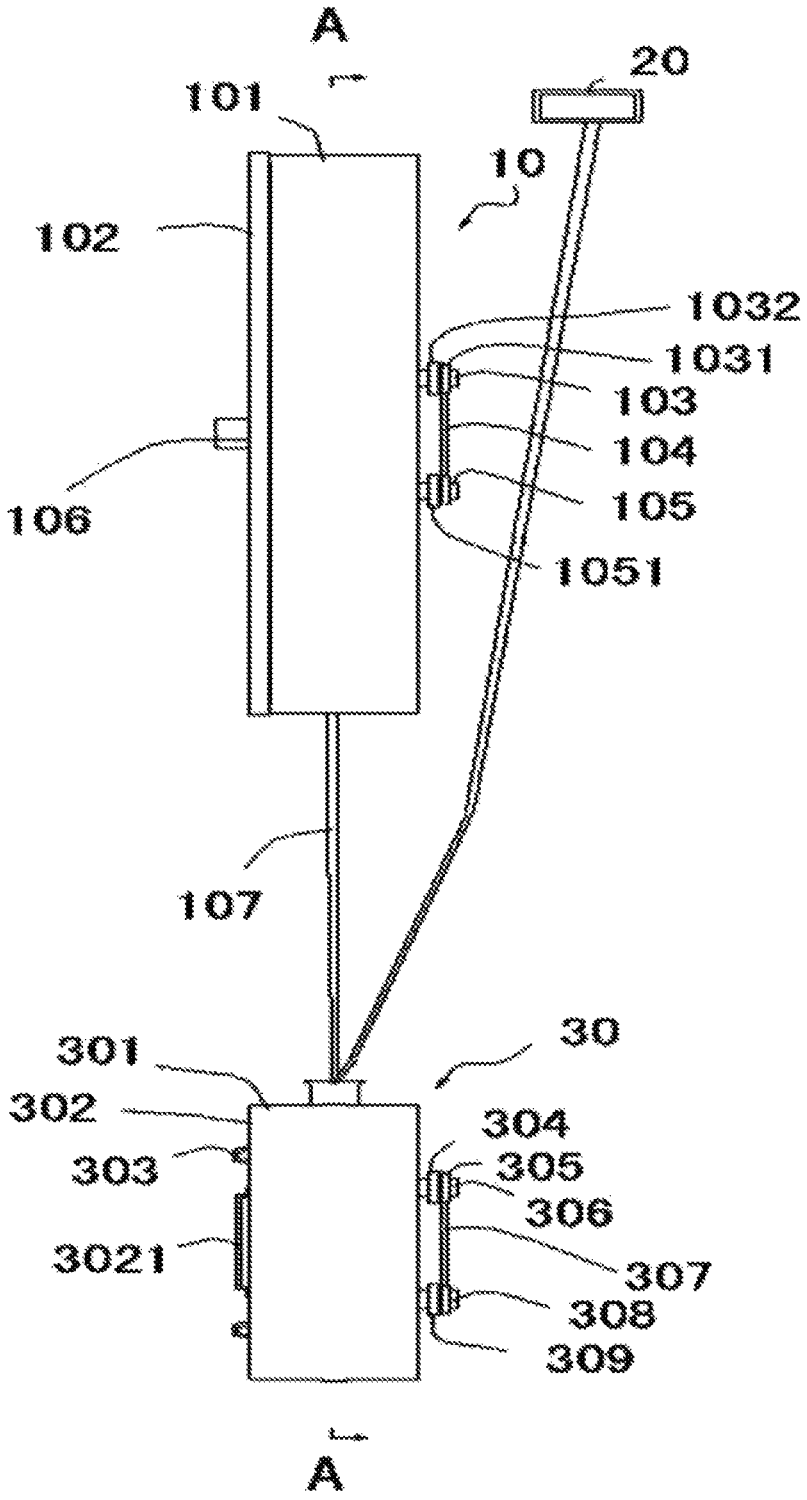
FIG. 1 is a side view showing art embodiment of the present disclosure.

Where: fixed plate 10, plate body 101, plate cover 102, upper camshaft 103, lock nut 1031, adjustment shaft 1032, rack 10321, connecting lever 104, lower camshaft 105, linkage arm 1051, central shaft 106, bearing 1061, washer 1062, fastening nut 1063, key 1064, sliding rope 107, inlet opening 1071, outlet opening 1072, winding wheel 1073, stop hub 108, stop pad 109, stop pad support 110, hanging ring 20, movable plate 30, housing 301, housing cover 302, dust cover 3021, buckle 303, control bar 304, fixing nut 305, driving shaft 306, connecting shaft 307, driven shaft 308, cam 3081, rocker 309, hinge pin 310, brake pad 311, brake pad support 312, movable end 3121, fixed end 3122, brake drum 313, inner lock nut. 3131, spacer 3132, pressure spring guide sleeve 314, pressure spring 3141, central shaft of movable plate 315, winding wheel of movable plate 316, key 317.

DESCRIPTION OF THE EMBODIMENTS

The speed-controllable lifter according to the present disclosure includes a fixed plate, a movable plate and a hanging ring. The fixed plate has a speed control device, the speed control device includes a stop hub, two stop pads, two arc-shaped stop pad supports and an adjustment means. The adjustment means includes an upper camshaft, a lower camshaft and an adjustment shaft arranged on the upper camshaft, an opening degree of movable ends of the two stop pad supports is adjustable via the adjustment shaft. A brake device is provided in the movable plate, the brake device includes a brake dram, a brake pad, two arc-shaped brake pad supports and a brake means; the brake means includes a driving shaft, a driven shaft and a control bar which is arranged on the driving shaft, movable ends of the two brake pad supports are controlled by the control bar.

For better understanding of the present disclosure, the embodiments are further described in detail below with reference to the drawings. Referring to FIG. 1, as a whole viewed from outside, the speed-controllable lifter according to this embodiment includes a fixed plate 10, a hanging ring 20 and a movable plate 30. In use, the fixed plate 10 is fixed at a high place, a rope 107 is also fixed at a high place via the hanging ring 20. The movable plate 30 is slidably hanged on the sliding rope 107. A protruding portion of a central shaft 106 can be seen protruding out from the middle of a plate cover 102 viewed from outside of the fixed plate 10. The protruding portion is configured to connect with a handle as an attachment part, for resetting sliding rope 107 after having been pulled out. A plate body 101 is connected to the plate cover 102 in a snap-fit manner. An upper camshaft 103, a lock nut 1031, an adjustment shaft 1032, a connecting lever 104, a lower camshaft 105 and a linkage arm 1051 can be seen from the right side of the plate body 101. The adjustment shaft 1032 and linkage arm 1051 are fixed by respective lock nuts 1031. The connecting lever 104 has two ends respectively hinged to the upper camshaft 103 and the lower camshaft 105 such that they are linked together in motion. A left side of a housing 301 of the movable plate 30 is connected with a housing cover 302 in a snap-fit manner, a buckle 303 is provided on the housing cover 302, and a dust cover 3021 is arranged at a center portion of the housing cover 302. The right side portion of the housing 301 has a configuration identical to the right side portion of the plate body 101 of the fixed plate 10. A control bar 304 is fixedly arranged on an exposed portion of a driving shaft 306 via a fixing nut 305. Two ends of a connecting shaft 307 are respectively hinged to ends of the driving shaft 306 and a driven shaft 308, so that the two shafts 306, 308 are linked together in motion.

Figure 2:
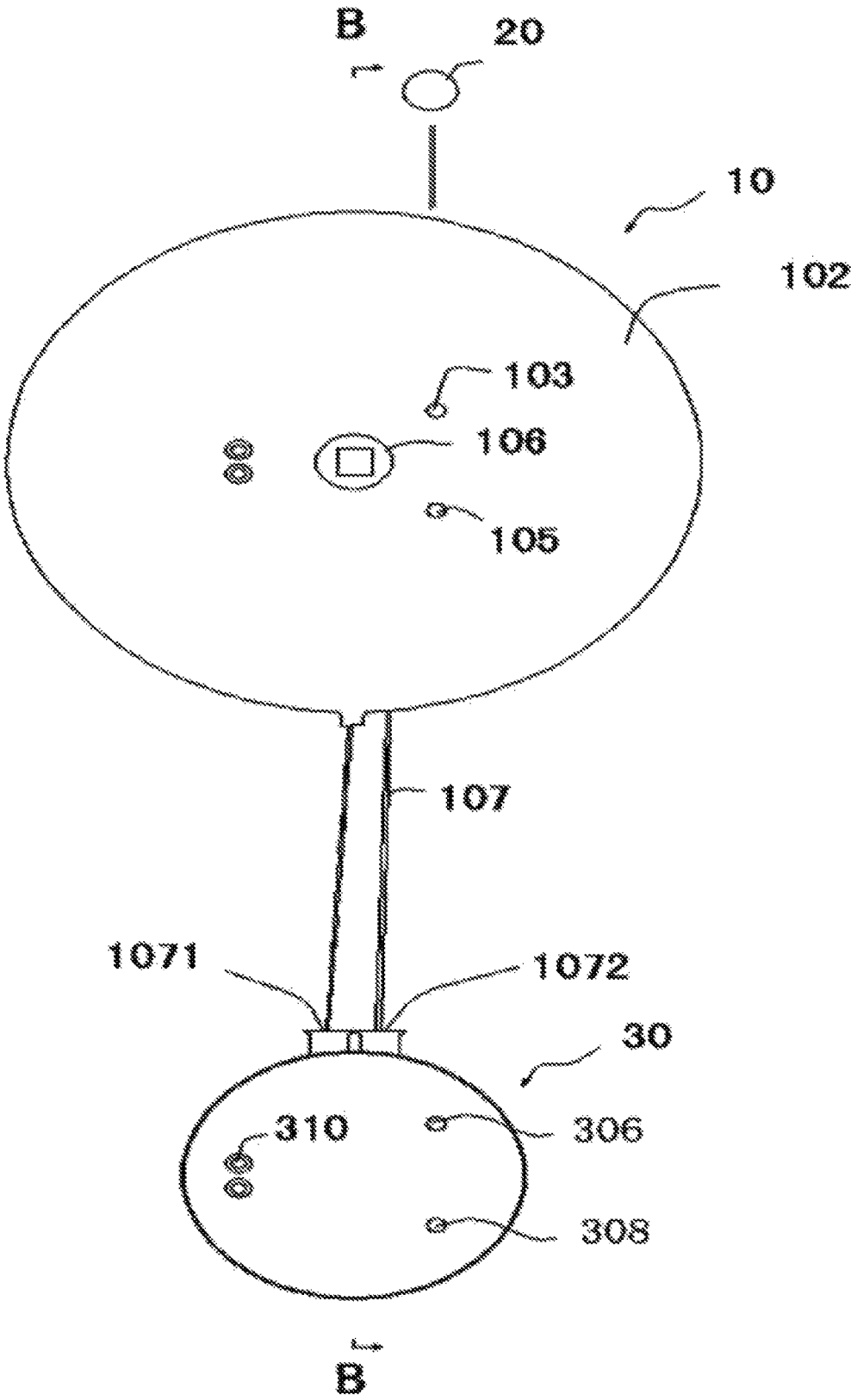
FIG. 2 is a left side view of FIG. 1, with a buckle, a dust cover, an adjustment shaft and a control bar omitted.
Figure 3:
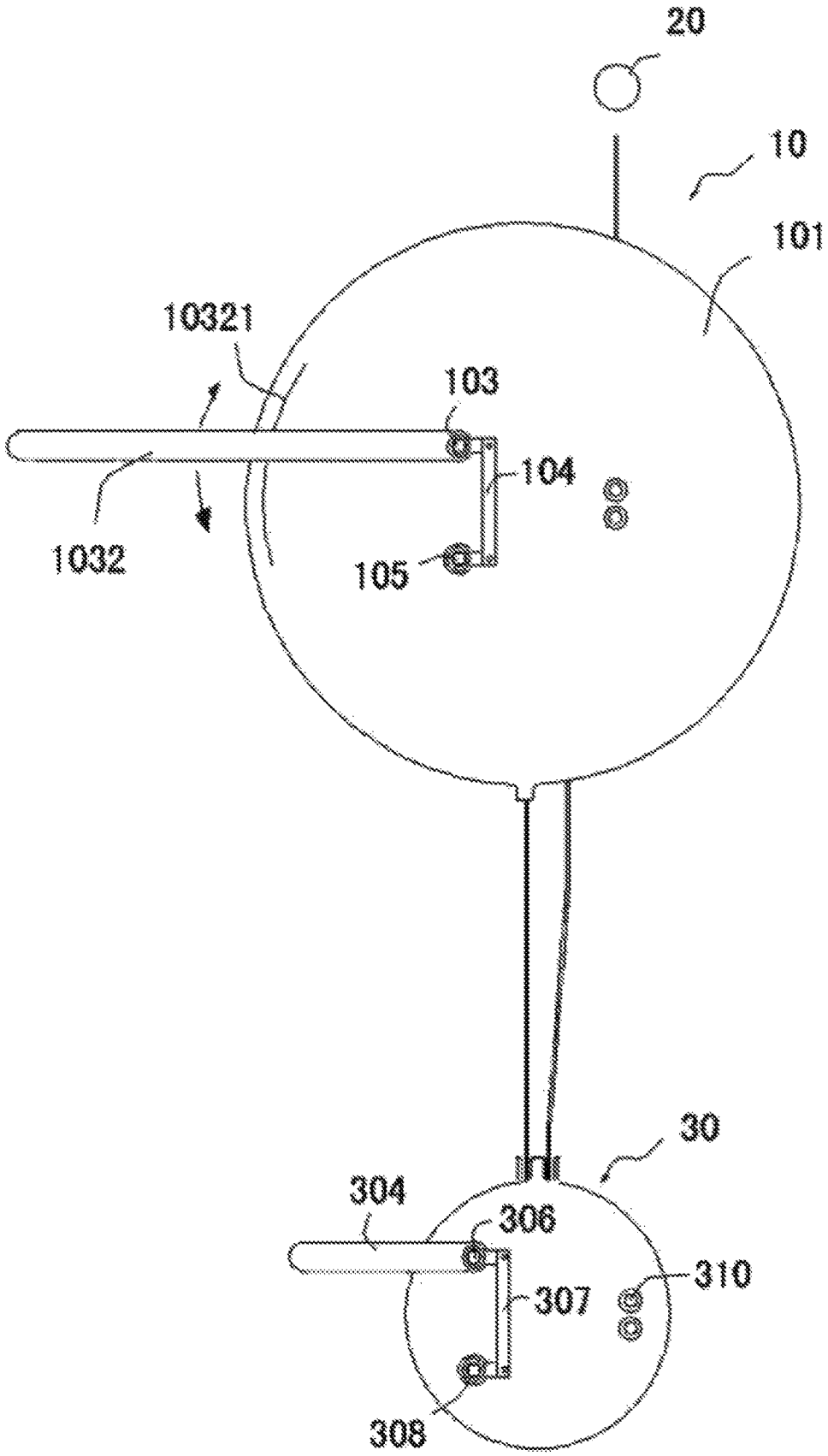
FIG. 3 is a right side view of FIG. 1.

Referring to FIG. 2, which is the left side view of FIG. 1, in which some components such as the adjustment shaft 1032 and the control bar 304 shown in FIG. 3 are not shown. The fixed plate 10 and the movable plate 30 are circular components. The central shaft 106 is provided at a central portion of the fixed plate 10. The protruding portion at the axial end of the central shaft 106 has a square cross section. The sliding rope 107 enters the movable plate 30 via an inlet opening 1071, and is wound around a winding wheel 316 in the movable plate, and then exits from the movable plate via the outlet opening 1072, and the end of the sliding rope 107 is fixed to the hanging ring 20. The fixed plate 10 and the movable plate 30 are provided with pins to fix fixed ends 3122 of the stop pad supports 110 and a fixed end of the brake pad supports 312, which will be described in detail later.

Referring to FIG. 3, the upper camshaft 103 and the lower camshaft 105 of the fixed plate 10 are arranged one above another at the outside of the plate body 101. The adjustment shaft 1032 is fixed on the upper camshaft 103. Two ends of the connecting lever 104 are respectively hinged to one end of the adjustment shaft 1032 and the linkage arm 1051 at the lower camshaft 105 such that they are linked together in motion. The body of the adjustment shaft 1032 is provided with a limit step, and an arc-shaped rack 10321 is provided on the plate body 101 to engage with the limit step. During operation, the adjustment shaft 1032 is pulled to move the limit step along the rack 10321. In the meanwhile, the upper camshaft 103 and the lower camshaft 105 rotates and accordingly adjusts clearance between the stop hub 108 and two stop pads 109, that is, adjusts an opening degree of the movable ends 3121 of the two stop pad supports 110.

The movable plate 30 has a configuration at its outside substantially identical to that of the fixed plate 10, with the brake device and its brake means and the speed control device and its adjustment means only different in usage. A speed of the movable plate 30 on the sliding rope 107 can be preset through the adjustment shaft 1032 of the fixed plate 10 (accordingly, the engagement between the limit step and the rack 10321 is required), while the control bar 304 of the movable plate 30 is provided for the evacuee to operate in real time. Where, the driving shaft 306 and the driven shaft 308 are arranged one above another, and the control bar 304 is fixed on the driving shaft 306, two ends of the connecting shaft 307 are hinged to one end of the driving shaft 306 and a rocker 309 of the driven shaft 308, such that the driving shaft and the driven shaft are linked together in motion.

Figure 4:
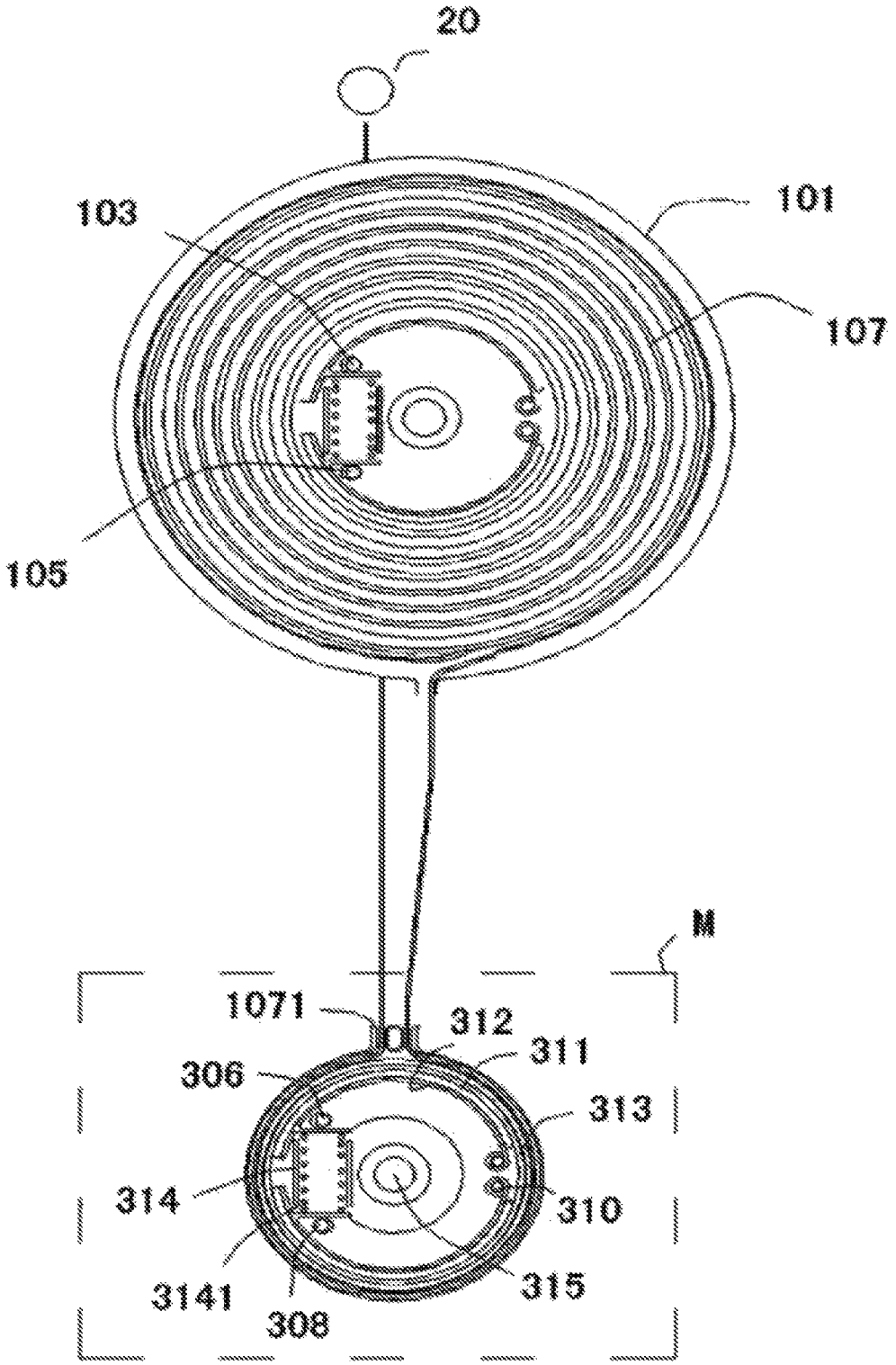
FIG. 4 is a cross-sectional view of FIG. 1 taken along a line A-A, in which a brake means of a movable plate is in an initial configuration.
Figure 5:
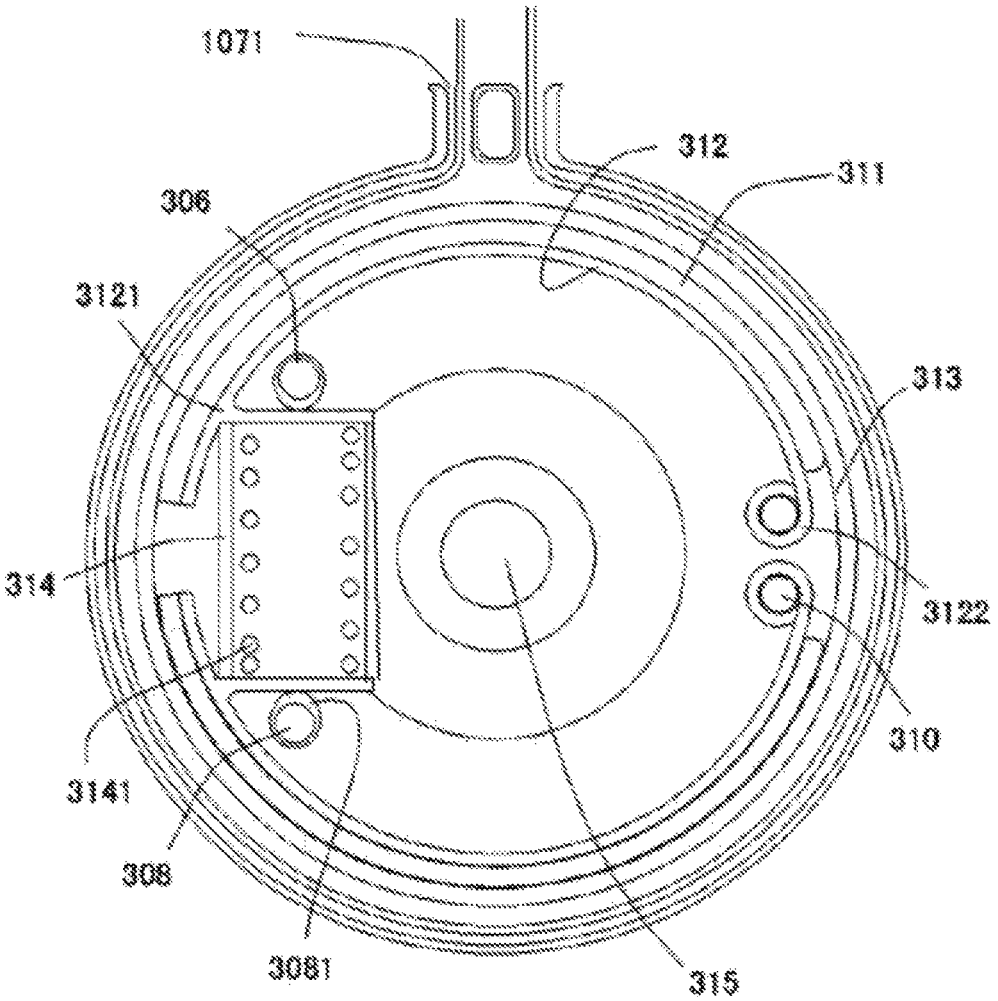
FIG. 5 is an enlarged view of a portion M of FIG. 4, but with the brake means changed to the operation configuration, that is, the driving shaft is rotated by 90 degrees.
Figure 6:
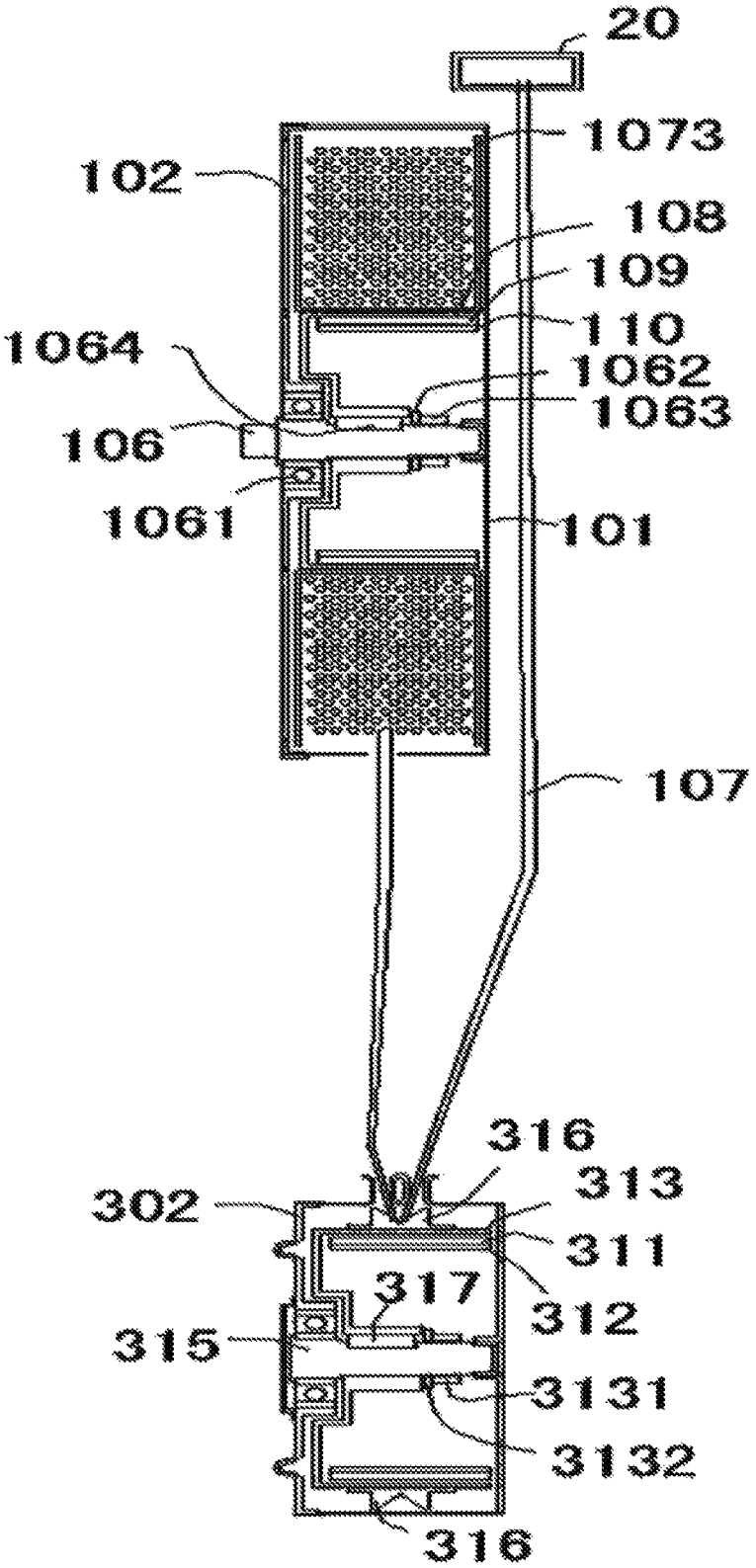
FIG. 6 is a cross-sectional view of FIG. 2, taken along a line B-B.

Referring to FIGS. 4, 5, and 6, through which, the internal structure of the fixed plate 10 and the movable plate 30 can be seen clearly. In the fixed plate 10, the sliding rope 107 is wound around a winding wheel 1073, and the winding wheel 1073 is fitted around a periphery of the stop hub 108 of the speed control device. In addition to the stop hub 108, the speed control device further includes two stop pads 109, two arc-shaped stop pad supports 110 and an adjustment means. The adjustment means is formed by the upper camshaft 103, the lower camshaft 105 and the adjustment shaft 1032 arranged on the upper camshaft 103. An opening angle between the movable ends of the two stop pad supports 110 is adjustable by the adjustment shaft 1032. The stop pads 109 and the stop pad supports 110 are sequentially arranged inside an inner ring area of the stop hub 108.

Since the internal structures of the fixed plate 10 and the movable plate 30 are substantially the same, that is, the components such as the stop hub 108 and the brake drum 313, the stop pad 109 and the brake pad 311, the stop pad support 110 and the brake pad support 312 are only called differently, i.e., with different names (for convenience of description). Therefore, the structure will be described in detail hereinafter with the movable plate 30 as example.

The winding wheel 316 of the movable plate is arranged around the outer periphery of the brake drum 313. The sliding rope 107 entering from the inlet opening 1071 is wound around the winding wheel 316. The terminal end of the sliding rope 107 extends out from the outlet opening 1072 and is fixed to the hanging ring 20. The brake pad 311 and the brake pad support 312 are arranged in the brake drum in sequence (the brake pad 311 and the brake pad support 312 are formed integrally, as one piece). The brake drum 313 is coupled to the central shaft 315 of the movable plate via a key 317. The brake pad supports 312 are in the form of two arc-shaped plates, with the fixed ends 3022 thereof positioned by a respective hinge pin 31. A driving block extends from the movable end 3121 of each arc-shaped plate. The driving shaft 306 and the driven shaft 308 are respectively arranged driving block at two opposite sides of the two driving blocks when considering the two driving blocks as a unit.

A pressure spring 3141 and a pressure spring guide sleeve 314 are arranged between the two driving blocks. When the driving shaft 306 rotates under the control of the control bar 304, the cams 3081 of the driving shaft and the driven shaft push the two driving blocks moving toward each other, causing the brake pad support 312 and the brake pad 311 as one piece move away from and disengage from the brake drum 313. Therefore, a clearance is formed between the brake drum 313 and the brake pads 311, which increases the slip speed of the rope and thus the movable plate. The slip speed is determined by the rotation angle of the cam 3081 by the control bar 304. The pressure spring guide sleeve 314 has a length shorter than a length of the pressure spring 3141 in its nature state.

In addition, in order to ensure that the person who are completely unable to escape by themselves, the movable plate 30 is provided with a limiting buckle for the control bar 304, and the limiting buckle is configured to fix the control bar 304, so that the pressure spring 3141 is in a compressed state and the brake is released. In that case, the movable plate 30 becomes a pulley, and its sliding speed is controlled by the adjustment shaft 1032 of the fixed plate 10.

In use, the fixed plate 10 and the hanging ring 20 are fixed in a proper position on the main body of the building, for example, near an escape window, and in the meanwhile the movable plate 30 is suspended on the sliding rope 107. The evacuee may wear a helmet and a protective vest, after a connecting latch on the vest belt having been connected to the buckle 303 of the movable plate 30, the evacuee can then get down over the window. Since the control bar 304 on the movable plate 30 is in an initial state at the beginning, that is, the pressure spring 3141 is in the uncompressed state, the movable plate 30 is unable to slid downwardly. When the evacuee presses the control bar 304, a clearance is thus formed between the brake drum 313 and the brake pad 311, and therefore the evacuee is able to slide downwardly due to his or her own weight. In case that there is a need to pause the sliding due to unexpected situation, it just needs to release the control bar 304. After the previous evacuee having been slidden down onto the ground, the latter evacuee at the high place may reset the rope by connecting the handle as an attachment to the protruding portion of the central shaft 106 of the fixed plate 10 and rotating the winding wheel 1073 in a reverse direction, and therefore the lifter can be used repeatedly for escape.

What is claimed is:

1. A speed-controllable lifter, comprising: a fixed plate (10), a movable plate (30) and a hanging ring (20), the fixed plate (10) and the hanging ring (20) being connected together with a sliding rope (107), the movable plate (30) being hanged on the sliding rope (107), the sliding rope (107) being wound around a winding wheel (1073) arranged in the fixed plate (10) with ends of the sliding rope (107) being fixed, characterized in that: a speed control device is provided in the fixed plate (10), the speed control device comprises a stop hub (108), two stop pads (109), two arc-shaped stop pad supports (110) and an adjustment means; the adjustment means comprises an upper camshaft (103), a lower camshaft (105) and an adjustment shaft (1032) arranged on the upper camshaft (103), an opening degree between movable ends of the two stop pad supports (110) is adjustable by the adjustment shaft (1032); the winding wheel (1073) is arranged on an outer periphery of the stop hub (108); a brake device is provided in the movable plate (30), the brake device comprises a brake drum (313), two brake pads (311), two arc-shaped brake pad supports (312) and a brake means; the brake means comprises a driving shaft (306), a driven shaft (308) and a control bar (304) arranged on the driving shaft (306), a degree of tightness of movable ends of the two brake pad supports (312) is controllable by the control bar (304).

2. The speed-controllable lifter of claim 1, wherein the upper camshaft (103) and the lower camshaft (105) are oppositely arranged, each on one side of a respective one of the two arc-shaped stop pad supports (110), and are hinged together by a connecting lever (104), the adjustment shaft (1032) is fixedly arranged on the upper camshaft (103), the adjustment shaft (1032) is provided with a limit step, and an arc-shaped rack (10321) is provided on the fixed plate (10) to engage with the limit step.

3. The speed-controllable lifter according to claim 1, wherein the driving shaft (306) and the driven shaft (308) are oppositely arranged, each on one side of a respective on of the two arc-shaped brake pad supports (312), and are hinged together by the connecting lever (104), the control bar (304) is fixedly arranged on the driving shaft (306), a pressure spring (3141) is provided between movable ends (3121) of the two brake pad supports (312), the control bar (304) and the pressure spring (3141) cooperate to control a tightness of the movable ends of the two brake pad supports.

4. The speed-controllable lifter according to claim 3, wherein a pressure spring guide sleeve (314) is arranged around a periphery of the pressure spring (3141), a length of the pressure spring guide sleeve (314) is shorter than a length of the pressure spring (3141) in its nature state.

5. The speed-controllable lifter according to claim 1, wherein a limiting buckle is provided on the movable plate (30), and the limiting buckle is engaged with the control bar (304), limiting a movement of the control bar (304).

* * * * *